United States Patent [19]

Wiggins et al.

[11] 4,063,848

[45] Dec. 20, 1977

[54] CENTRIFUGAL COMPRESSOR VANELESS SPACE CASING TREATMENT

[75] Inventors: Jesse O. Wiggins; Gerry L. Waltz, both of Peoria, Ill.

[73] Assignee: Caterpillar Tractor Co., Peoria, Ill.

[21] Appl. No.: 670,029

[22] Filed: Mar. 24, 1976

[51] Int. Cl.[2] ..... F04D 17/10; F04D 29/44

[52] U.S. Cl. ..... 415/206; 415/211

[58] Field of Search ..... 415/53, 213 R, DIG. 1, 415/211, 204, 206, 219 B, 219 A; 416/183

[56] References Cited

U.S. PATENT DOCUMENTS

| | | | |
|---|---|---|---|
| 1,663,998 | 3/1928 | Schmidt | 415/204 |
| 2,814,434 | 11/1957 | Boyd | 415/206 |
| 2,925,952 | 2/1960 | Garve | 415/219 A |
| 3,893,787 | 7/1975 | Jones | 415/DIG. 1 |

FOREIGN PATENT DOCUMENTS

| | | | |
|---|---|---|---|
| 503,332 | 5/1954 | Canada | 415/213 R |
| 963,540 | 1/1950 | France | 415/DIG. 1 |
| 893,205 | 1/1944 | France | 416/183 |
| 1,057,137 | 5/1959 | Germany | 415/213 R |
| 4,642,817 | 4/1971 | Japan | 415/213 R |
| 937,987 | 9/1963 | United Kingdom | 415/DIG. 1 |

*Primary Examiner*—Everette A. Powell, Jr.
*Attorney, Agent, or Firm*—Phillips, Moore, Weissenberger, Lempio & Majestic

[57] ABSTRACT

The invention is concerned with an improvement in a centrifugal compressor. Such a compressor includes an inducer section including an impeller having a plurality of impeller blades rotatingly driven by a shaft of the compressor to impel air centrifugally outwardly from the shaft with an air intake duct defined by a casing radially about the impeller blades and a diffuser having a plurality of diffuser vanes in said duct downstream a spaced vane-free distance from a downstream end of the inducer. The improvement of the invention comprises a slot extending into the casing upstream of the diffuser vanes to bring about a reduction in surge flow and hence a reduction in a flow value at which stalling of the compressor occurs. Generally, the slot comprises a circumferential groove in the casing. In a preferred embodiment of the invention the slot is located intermediate the inducer and the diffuser vanes.

2 Claims, 3 Drawing Figures

CENTRIFUGAL COMPRESSOR VANELESS SPACE CASING TREATMENT

BACKGROUND OF THE INVENTION

1. Field of the Invention

The invention is particularly related to the art of centrifugal compressors as used in gas turbine engines. More particularly, the invention is concerned with an improved treatment for the casing in the inducer-diffuser section of a centrifugal compressor which leads to a reduction in surge flow and hence to a reduction in the flow value at which stalling of the inducer section of the compressor occurs.

2. Prior Art

The prior art teaches centrifugal compressors which include an inducer section including an impeller having a plurality of impeller blades rotatingly driven by a shaft of the compressor to impel air centrifugally outwardly from the shaft with an air intake duct defined in a casing radially about the impeller blades and a diffuser with a plurality of diffuser vanes in the duct downstream a spaced vane-free distance from a downstream end of the impeller. The prior art does not teach providing any slots, grooves, or the like in the casing of a centrifugal compressor to in any way affect surge flow and thereby the minimum flow value at which stalling of the inducer section of the compressor occurs. Some use has been made of internal grooving and/or other types of slots in axial compressors but the flow paths therein are so different than the flow paths within centrifugal compressors that it was not previously believed that such treatment could affect centrifugal compressors in an advantageous manner.

SUMMARY OF THE INVENTION

The invention is concerned with an improvement in a centrifugal compressor which includes an inducer section including an impeller having a plurality of impeller blades rotatingly driven by a shaft or said compressor to impel air centrifugally outwardly from said shaft with an air intake duct defined by a casing radially about the impeller blades and a diffuser section including a plurality of diffuser vanes in the air duct downstream of a vane-free space which is downstream of the impeller. The improvement comprises a slot extending into said casing upstream of said diffuser vanes, said slot being generally equally spaced circumferentially about said shaft to bring about a reduction in surge flow and hence a reduction in a flow value at which stalling of the compressor occurs.

BRIEF DESCRIPTION OF THE DRAWINGS

The invention will be better understood by reference to the figures of the drawings wherein like numbers denote like parts throughout, and wherein.

DETAILED DESCRIPTION OF THE PREFERRED EMBODIMENT

Figure 1:
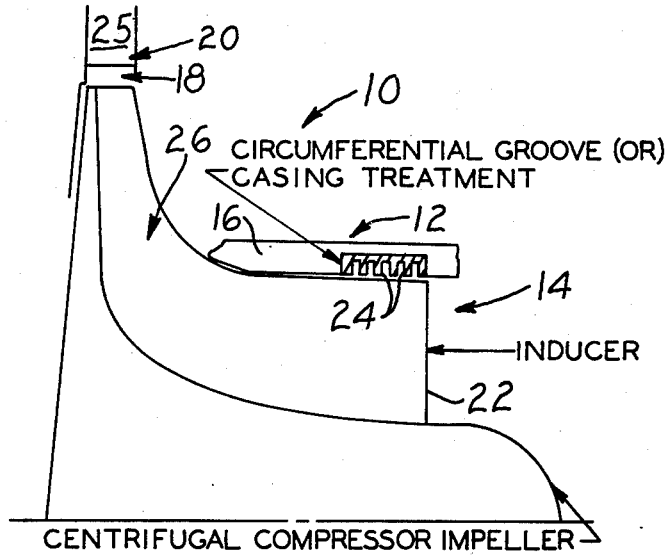
FIG. 1 illustrates an improved centrifugal compressor in accordance with the present invention wherein a plurality of slots are provided adjacent the furthest-upstream end of the inducer section.

Turning now to the figures of the drawings, an improved inducer 10, in accordance with the present invention for a centrifugal compressor, is illustrated. Air enters an inducer section 12 at a mouth 14 thereof and proceeds therefrom within a casing 16 past a vane-free space 18 to a diffuser section 20. The air is accelerated by the action of a plurality of impeller blades 22, one of which is illustrated in each of FIGS. 1 and 3, which rotate in a usual manner with the shaft of the centrifugal compressor. The casing 16 of FIG. 1 has therein a plurality of slots 24, which serve to bring about a reduction in surge flow and in a flow value at which stalling of the compressor occurs. The slots 24 are generally equally spaced circumferentially about the shaft of the compressor so as to provide an equal and uniform effect upon gas flow through the compressor. The impeller blades 22 and a plurality of diffuser vanes 25 are all within an air intake duct 26 defined by the casing 16. As will be noted from FIG. 1, the slots 24 preferably comprise parallel circumferential grooves in the casing 16.

Figure 3:
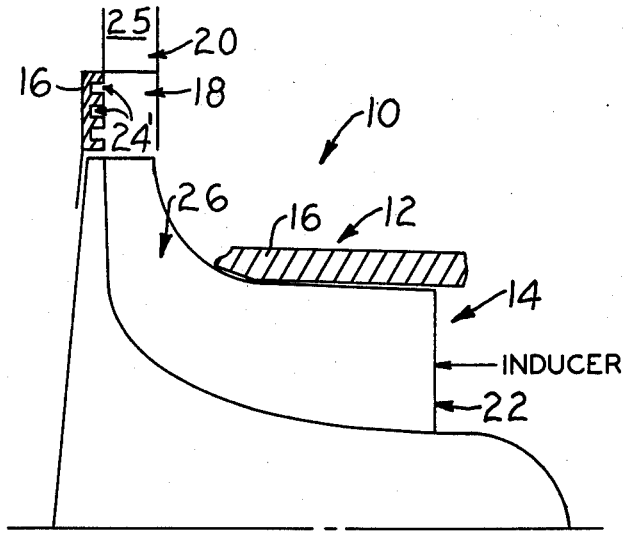

Referring to FIG. 3, there is illustrated an embodiment which is an alternative embodiment of the invention and wherein a single slot 24 is located in the vane-free space 18 intermediate the impeller blades 22 of inducer section 12 and the diffuser section 20. A plurality of slots 24, as in FIG. 1, can also be used in this section 18. Once again in this embodiment, the slot 24 preferably comprises a circumferential groove in the casing 16, concentric with the outside diameter of the impeller blades 22.

Figure 2:
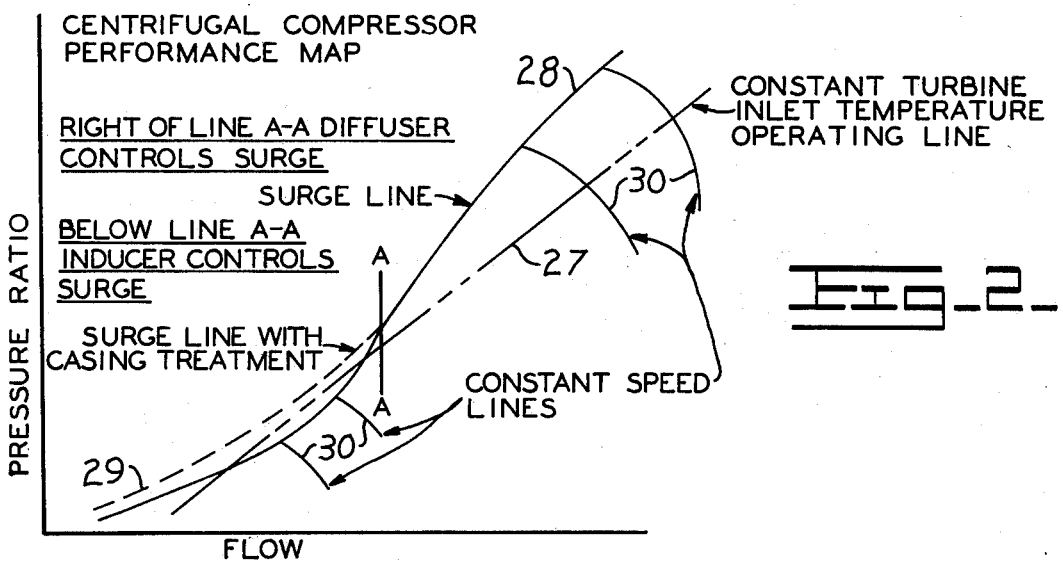
FIG. 2 illustrates graphically the results of the improvement of the present invention upon centrifugal compressor performance; and, FIG. 3 illustrates an embodiment of the present invention as in FIG. 1 wherein a single slot is located in the vane-free space intermediate of the end of the impeller and the diffuser vanes.

Turning now to FIG. 2, there is illustrated therein the effect upon surge flow and minimum flow at which stalling of the compressor occurs when a slot or a plurality of slots 24 (or 24' as in FIG. 3) in accordance with the present invention are used in a centrifugal compressor. The alternately long and short dashed line 27 in FIG. 2 represents operation which takes place at constant turbine inlet temperature. The solid line 28 in FIG. 2 represents the normal surge flow line in the absence of the slot or slots 24 of the present invention. The line 29 of equal length short dashes, which is shown as a continuation of the surge flow line to the left of line A—A, illustrates the surge flow line with a centrifugal compressor including the slot or slots 24 of the present invention. The abscissa represents flow and the ordinate represents a pressure ratio produced by the compressor. Also indicated in FIG. 2 are a series of constant speed lines 30 where the speed represents constant speed of the centrifugal compressor. It is to be noted that when the surge line passes to a lower pressure ratio than the constant inlet temperature operating line, one attains a situation wherein stalling of the compressor will tend to occur. Thus, it is desirable to move the slow speed surge line (the solid line to the left of A—A) to a lower flow rate at a given speed. Through the use of the slot or slots 24 of the present invention this is accomplished (as illustrated in FIG. 2 by the line 29 with equal length short dashes). It should be noted that the compressor surge characteristics to the left of the line A—A is controlled by the inducer section 12 of the compressor. The present invention thus serves to increase inducer flow stability and thereby move the inducer stall and the resultant surge to a lower flow rate. As a result of the improved low speed surge line, the desired engine operating line passes through the stable operating range of the compressor over the entire range of speeds. To the right of line A—A the diffuser section 20 controls surge.

When the slot or slots 24' are placed in the vane-free space 18 as illustrated in FIG. 3 it has been found that the above advantages are obtained and that, further, no adverse effects of any magnitude occur when the centrifugal compressor is operated at its normal high speed. Thus, with the slot or slots 24' in the form of circumferential grooves in the casing 16 in the vane-free section 18, at a 2:1 pressure ratio one finds a reduction in surge flow of approximately 7%. At a pressure ratio of 4.7 one finds an efficiency of 77.4%. The efficiency of a similar compressor which does not have the slot or slots 24' is quite comparable, namely about 78.9%. Thus, one obtains a significant surge flow reduction (and hence reduced stalling tendency) as is desirable for only a slight loss in efficiency at high speed operation.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a centrifugal compressor which includes an inducer section including an impeller having a plurality of impeller blades rotatingly driven by a shaft of said compressor to impel air centrifugally outwardly from said shaft with an air duct defined by a casing radially about said impeller blades and a diffuser section including a plurality of diffuser vanes in said air duct downstream of a vane-free space a distance downstream of said impeller, an improvement comprising:

a circumferential groove extending into said casing in said vane-free space upstream of said diffuser vanes and downstream of said impeller blades, said groove being generally equally spaced circumferentially about said shaft, to bring about a reduction in surge flow and hence a reduction in a flow value at which stalling of the inducer section occurs without bringing about adverse effects of significant magnitude during normal high speed compressor operation.

2. An improvement as in claim 1, wherein said groove is one of a plurality of parallel grooves.

* * * * *